US007913420B2

(12) United States Patent
Arizumi

(10) Patent No.: US 7,913,420 B2
(45) Date of Patent: Mar. 29, 2011

(54) SKATEBOARD SHOE WITH TEXTURED SURFACE

(75) Inventor: James K. Arizumi, Portland, OR (US)

(73) Assignee: NIKE, Inc., Beaverton, OH (US)

( * ) Notice: Subject to any disclaimer, the term of this patent is extended or adjusted under 35 U.S.C. 154(b) by 723 days.

(21) Appl. No.: 11/626,831

(22) Filed: Jan. 24, 2007

(65) Prior Publication Data

US 2007/0256328 A1 Nov. 8, 2007

Related U.S. Application Data

(60) Provisional application No. 60/761,847, filed on Jan. 24, 2006.

(51) Int. Cl.
*A43B 7/06* (2006.01)
*A43B 23/02* (2006.01)

(52) U.S. Cl. ..... 36/3 A; 36/45

(58) Field of Classification Search ..... 36/3 A, 36/45, 133, 3 R, 8.1, 72 R
See application file for complete search history.

(56) References Cited

U.S. PATENT DOCUMENTS

| | | | | | |
|---|---|---|---|---|---|
| 1,746,427 | A | * | 2/1930 | Howland | 2/68 |
| 1,806,673 | A | * | 5/1931 | Daniels | 36/3 A |
| 2,082,309 | A | * | 6/1937 | Turiansky | 36/3 A |
| 2,118,255 | A | * | 5/1938 | Loucks et al. | 36/3 A |
| 3,025,614 | A | * | 3/1962 | Bingham, Jr. | 36/3 R |
| 3,605,292 | A | * | 9/1971 | Goldblatt | 36/8.1 |
| 4,232,458 | A | * | 11/1980 | Bartels | 36/45 |
| 4,296,499 | A | * | 10/1981 | Patterson et al. | 2/239 |
| 4,562,652 | A | * | 1/1986 | Hensler | 36/102 |
| 5,339,545 | A | * | 8/1994 | Paris | 36/117.6 |
| 5,454,172 | A | * | 10/1995 | Crigger | 36/72 R |
| 7,155,846 | B2 | * | 1/2007 | Alfaro et al. | 36/136 |
| 2004/0055183 | A1 | * | 3/2004 | Lee et al. | 36/128 |
| 2005/0016023 | A1 | | 1/2005 | Burris et al. | |
| 2005/0241179 | A1 | * | 11/2005 | Chen | 36/3 A |
| 2006/0048413 | A1 | * | 3/2006 | Sokolowski et al. | 36/45 |

FOREIGN PATENT DOCUMENTS

| | | |
|---|---|---|
| DE | 2801984 | 7/1979 |
| EP | 0741004 | 11/1996 |
| GB | 06995 | 0/1901 |
| WO | 2006063019 | 6/2006 |

OTHER PUBLICATIONS

International Search Report in corresponding PCT Application, International App. No. PCT/US2007/061004, mailed Jun. 1, 2007.

* cited by examiner

*Primary Examiner* — Ted Kavanaugh
(74) *Attorney, Agent, or Firm* — Banner & Witcoff, Ltd.

(57) ABSTRACT

Footwear having a textured surface. The footwear may have an upper, where at least a portion of the footwear upper has a textured surface. The textured surface may be formed, at least in part, by contoured structures. These contoured structures may define a group of alternating peaks and troughs extending in two orthogonal directions. The textured surface may optionally include apertures that will allow air to pass through the upper into the shoe, and allow moisture to expire from the inside of the shoe into the air.

30 Claims, 6 Drawing Sheets

SKATEBOARD SHOE WITH TEXTURED SURFACE

RELATED APPLICATIONS

This application claims priority under 35 U.S.C. §119 to U.S. Provisional Patent Application No. 60/761,847, entitled "Skateboard Shoe With Textured Surface," filed on Jan. 24, 2006, and naming James Arizumi as inventor, which provisional patent application is incorporated entirely herein by reference.

FIELD OF THE INVENTION

The present invention relates to an article of footwear useful for performing various activities on a skateboard. More particularly, various examples of invention relate to an article of footwear having an upper with at least part of its surface textured.

BACKGROUND OF THE INVENTION

Skateboarding has been a very popular activity for a number of years. In addition to simply riding on a skateboard, however, many skateboarders now try to perform complex tricks, which have become more and more difficult as each new generation of skateboarders tries to outdo the last. Many skateboarding tricks require the skateboarder to flip or otherwise reposition the skateboard using his or her feet. For example, at the apex of a jump, a skateboarder might use his or her foot to flip the skateboard so that it rotates 360°, but still lands on its wheels so that the skateboarder can, in turn, land on the skateboard at the end of the jump. Typically, the skateboarder will use the top surface of his or her shoe to "grab" the underside of the skateboard in order to flip it. While this type of trick would be difficult under any circumstances, the skateboarder's footwear can make this type of trick even more difficult. For example, if the footwear has a smooth upper surface, this surface may not provide enough friction to allow the skateboarder to successfully grab the skateboard. Accordingly, it would be desirable to provide footwear for use with skateboarding that allows the skateboarder to more securely and better control flipping or other movement of the skateboard with his or her foot.

BRIEF SUMMARY OF THE INVENTION

Various aspects of the invention relate to footwear having a textured surface. More particularly, some aspects of the invention relate to footwear having an upper, where at least a portion of the footwear upper has a textured surface that will provide friction for grabbing a skateboard during a skateboarding trick. According to some examples of the invention, an article of footwear is provided with an upper having a top surface formed, at least in part, by contoured structures. For example, these contoured structures may define a group of alternating peaks and troughs extending in two orthogonal directions. Still further, the textured surface may optionally include apertures that will allow air to pass through the upper into the shoe, and allow moisture to expire from the inside of the shoe into the air.

BRIEF DESCRIPTION OF THE DRAWINGS

The foregoing Summary, as well as the following Detailed Description, will be better understood when read in conjunction with the accompanying drawings.

DETAILED DESCRIPTION OF THE INVENTION

The following discussion and accompanying figures disclose an article of footwear having an upper with a textured surface in accordance with various aspects of the present invention. Concepts related to the textured surface are disclosed with reference to an article of athletic footwear having a configuration suitable for the activity of skateboarding. The textured surface is not solely limited to footwear designed for skateboarding, however, and may be incorporated into a wide range of athletic footwear styles, including shoes that are suitable for baseball, basketball, cross-training, football, rugby, soccer, tennis, volleyball, and walking, for example. In addition, a textured surface according to various embodiments of the invention may be incorporated into footwear that is generally considered to be non-athletic, including a variety of dress shoes, casual shoes, sandals, and boots. An individual skilled in the relevant art will appreciate, therefore, that the concepts disclosed herein with regard to the textured surface applies to a wide variety of footwear styles, in addition to the specific styles discussed in the following material and depicted in the accompanying figures.

Figure 1:
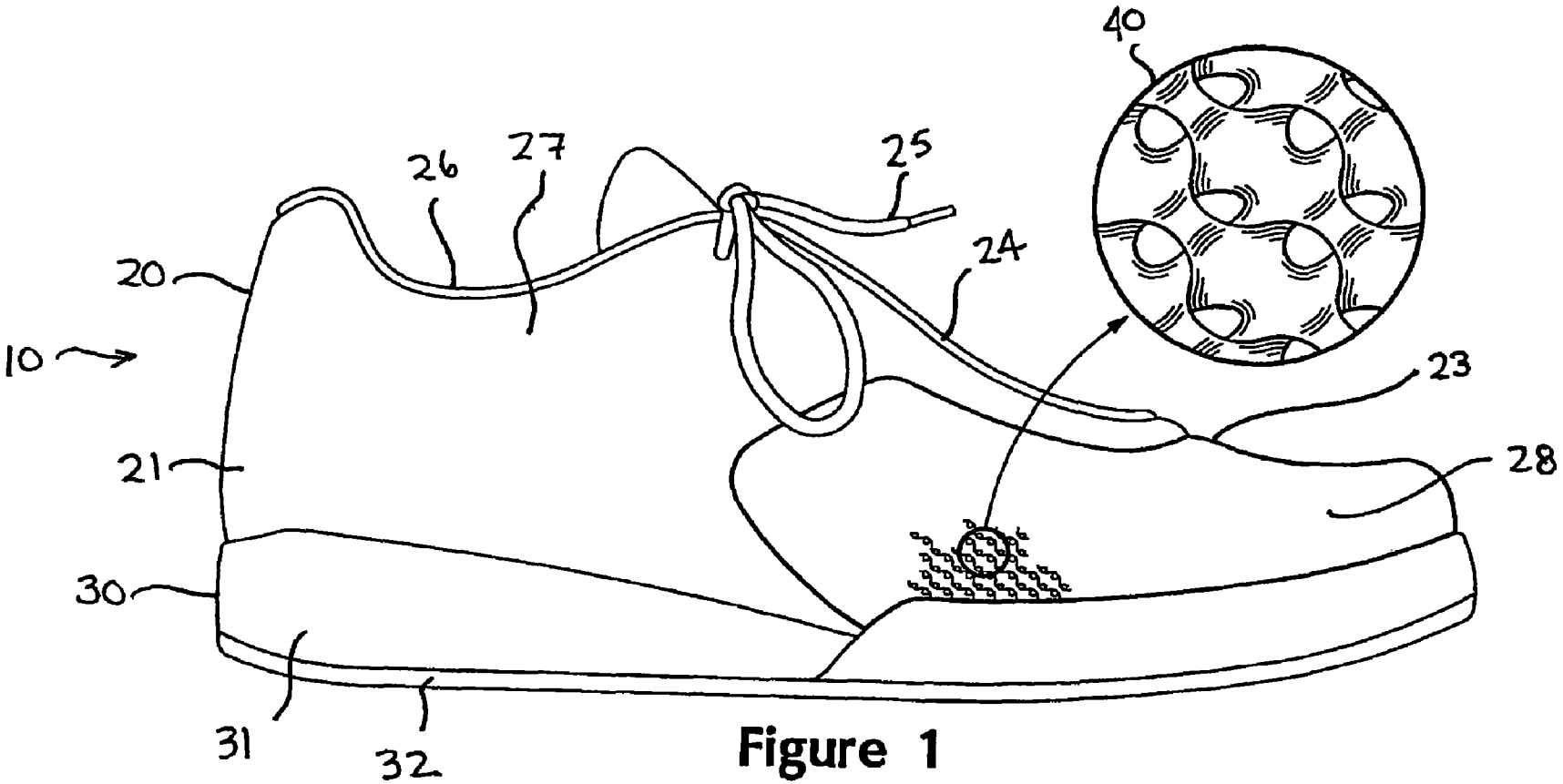
FIG. 1 is a lateral side elevational view of an article of footwear having an upper with a contoured layer in accordance with aspects of the invention.
Figure 2:
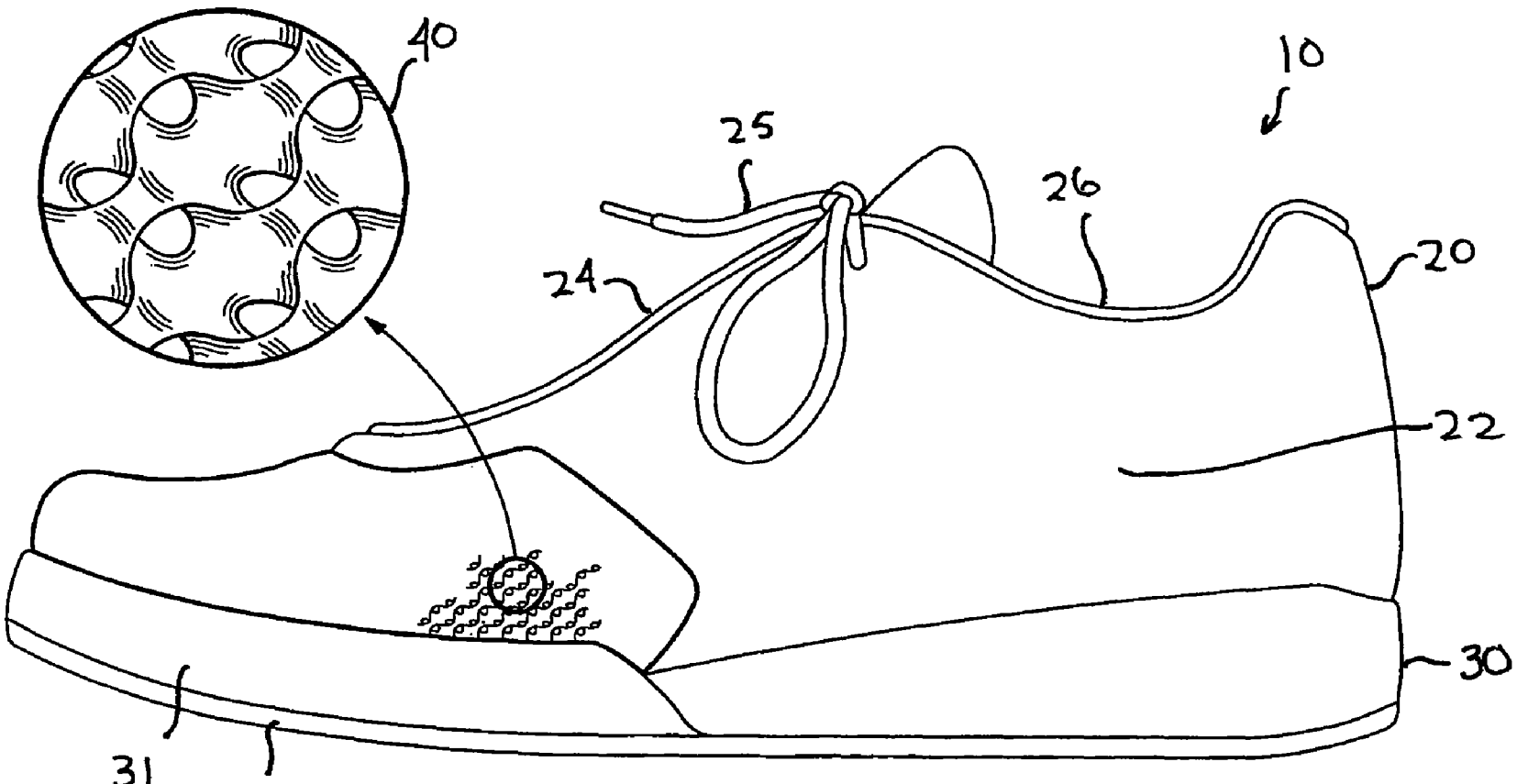
FIG. 2 is a medial side elevational view of the article of footwear shown in FIG. 1.
Figure 3:
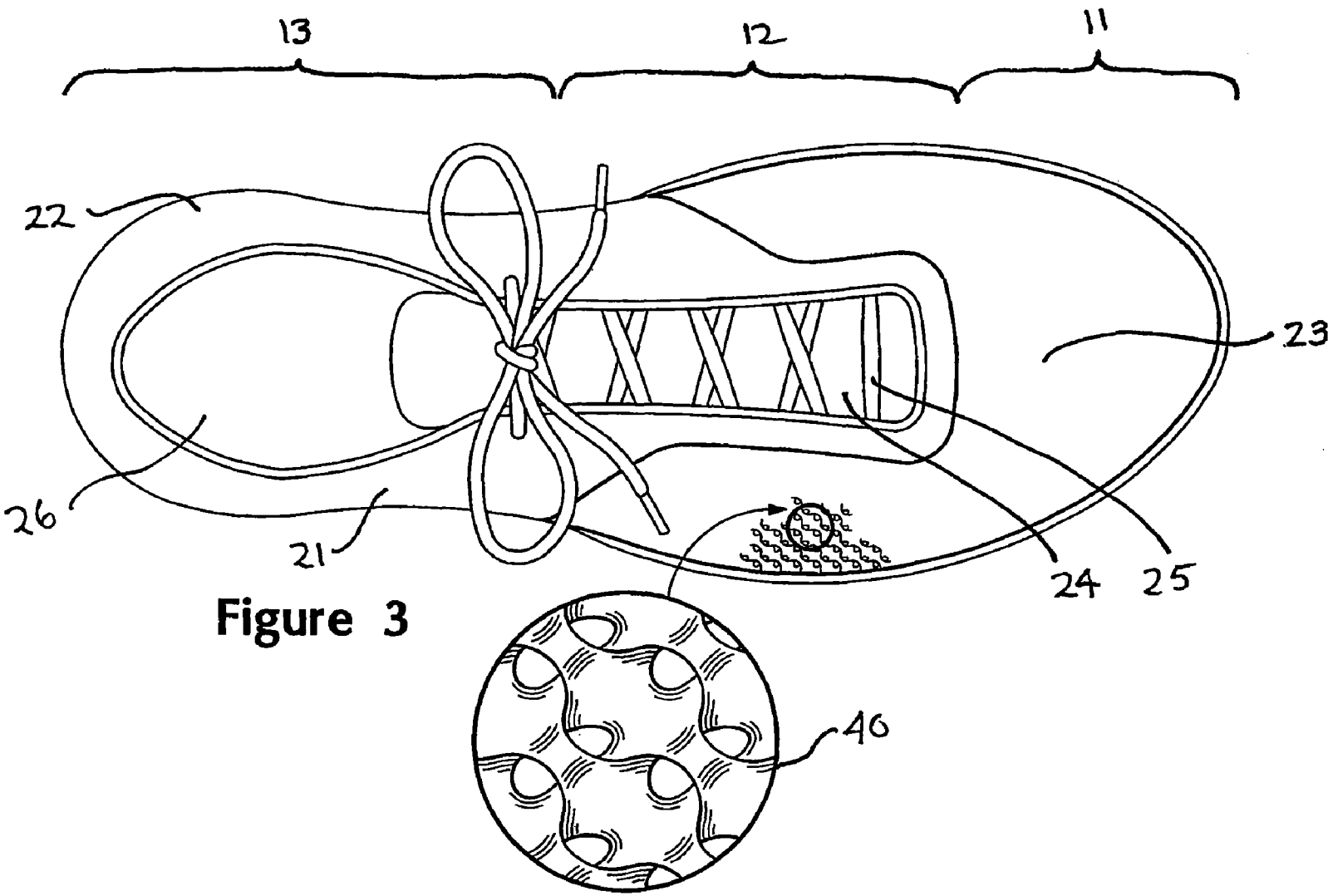
FIG. 3 is a top plan view of the article of footwear shown in FIG. 1.

An article of footwear 10 is depicted in FIGS. 1-3 as including an upper 20 and a sole structure 30. For purposes of reference in the following material, footwear 10 may be divided into three general regions: a forefoot region 11, a midfoot region 12, and a heel region 13, as defined in FIG. 3. Regions 11-13 are not intended to demarcate precise areas of footwear 10. Rather, regions 11-13 are intended to represent general areas of footwear 10 that provide a frame of reference during the following discussion. Although regions 11-13 apply generally to footwear 10, references to regions 11-13 may also apply specifically to upper 20, sole structure 30, or an individual component within either upper 20 or sole structure 30.

Upper 20 is secured to sole structure 30 and defines a void for receiving a foot. For purposes of reference, upper 20 includes a lateral side 21, an opposite medial side 22, and a vamp area 23. Lateral side 21 is positioned to extend along a lateral side of the foot and generally passes through each of regions 11-13. Similarly, medial side 22 is positioned to extend along an opposite medial side of the foot and generally passes through each of regions 11-13. Vamp area 23 is positioned between lateral side 21 and medial side 22 to correspond with an upper surface of the foot. Vamp area 23 includes a throat 24 having a lace 25 or any other closure mechanism that is utilized in a conventional manner to modify the dimensions of upper 20 relative the foot, thereby adjusting the fit of footwear 10. Upper 20 also includes an ankle opening 26 that provides the foot with access to the void within upper 20.

Sole structure 30 is secured to a lower surface of upper 20 and has a generally conventional structure that includes a midsole 31 and an outsole 32. Midsole 31 may be formed of polymer foam material, such as polyurethane or ethylvinylacetate, which compresses to attenuate ground reaction forces during walking, running, or other ambulatory activities. In some aspects of the invention, the polymer foam material may encapsulate or include various elements, such as a fluid-filled bladder or moderator, which enhances the comfort, motion-control qualities, stability, or ground reaction force attenuation of footwear 10. Outsole 32 is secured to a lower surface of midsole 31 and is formed of a wear-resistant material, such as rubber, that contacts the ground during the ambulatory activities. The material forming outsole 32 may be textured to impart enhanced traction and slip resistance. Footwear 10 may also include a sockliner, which is a thin, compressible member that is located within the void in upper 20 and adjacent to a lower surface of the foot to enhance the comfort of footwear 10. Although the configuration of sole structure 30 discussed above is suitable for footwear 10, sole structure 30 may exhibit the configuration of any conventional or non-conventional sole structure.

As seen in FIGS. 1-3, the upper 20 is divided into two portions: a rear portion 27, and a front portion 28. In the illustrated example, the front portion 28 extends over the top of the forefoot region 11 to the midfoot region 12. This front portion 28 also extends along either side of the shoe 10 to the heel region 13. The rear portion 27 of the upper 20 then extends from the front portion 28 through the heel region 13 of the shoe 10. Thus, the front portion 28 of the upper 20 covers the portion of the foot that a skateboarder would normally use to flip or otherwise manipulate a skateboard.

As also seen in these figures, the top of the front portion 28 has a textured surface 40. As will be discussed in more detail below, this textured surface 40 provides the front portion 28 with a rough, irregular covering. This textured surface 40 is configured to provide the wearer with improved traction when the front portion 28 of the shoe 10 is rubbed against another surface, such as the top, bottom, or edge of a skateboard deck. Thus, the textured surface 40 of the front portion 28 will provide a skateboarder with better grip and improved feel when manipulating a skateboard.

Figure 4:
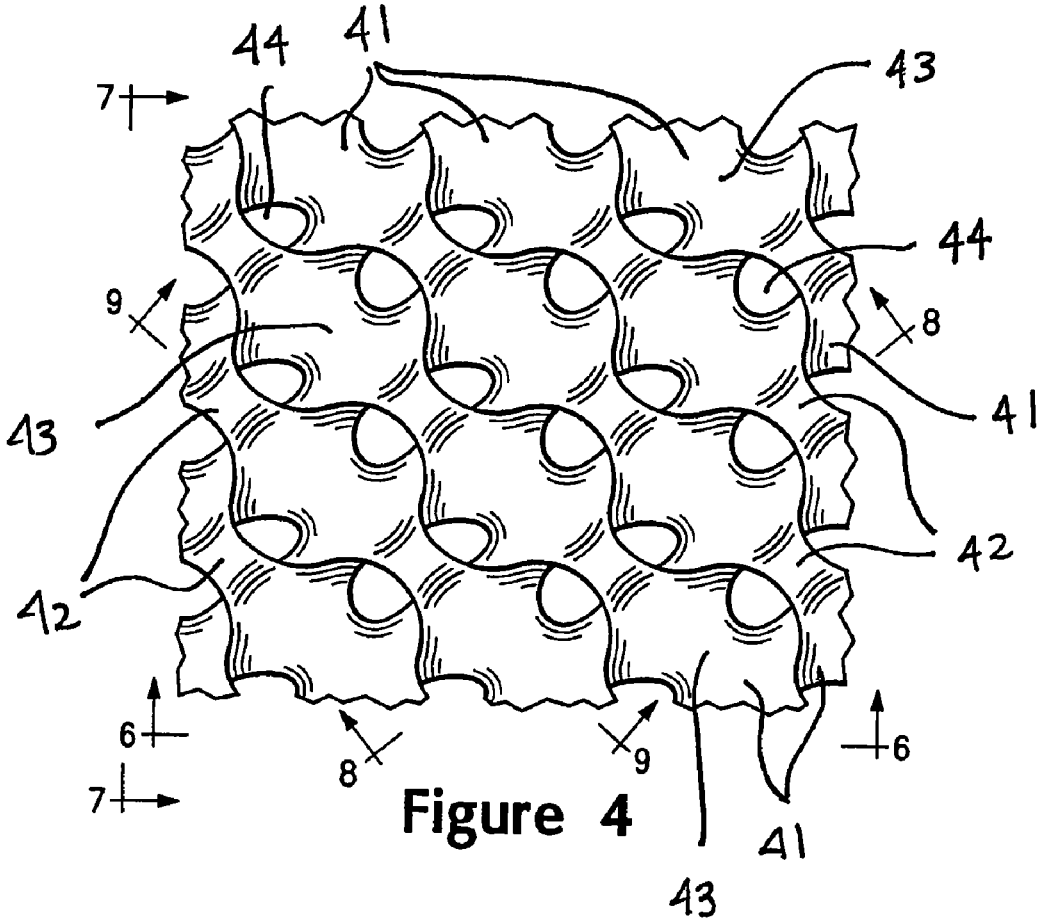
FIG. 4 is a top plan view of the textured surface shown in FIGS. 1-3.
Figure 5:
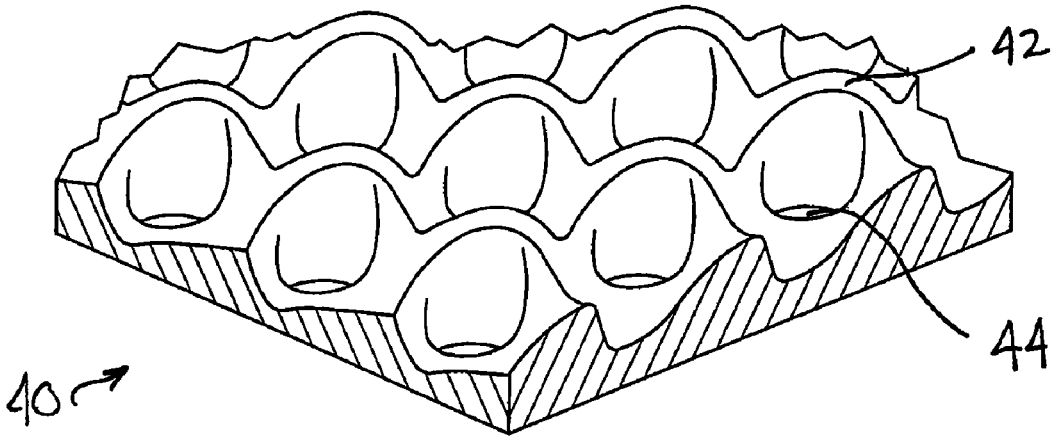
FIG. 5 is a perspective view of the textured surface shown in FIGS. 1-3.
Figure 6:
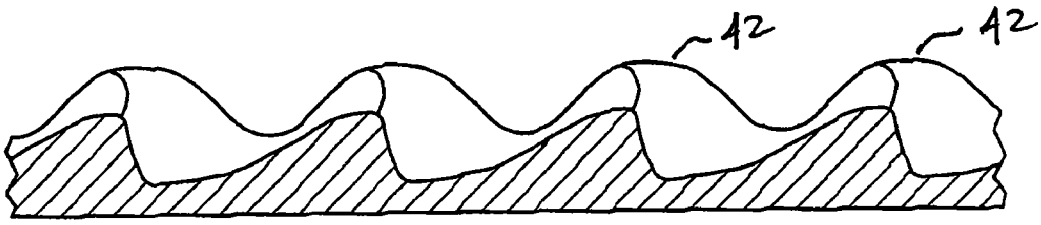
FIG. 6 illustrates a cross section of the textured surface shown in FIGS. 1-3 along line 6-6 shown in FIG. 4.
Figure 7:
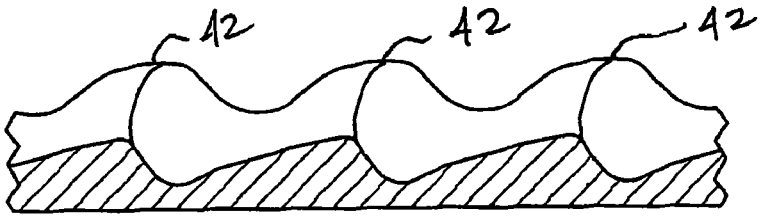
FIG. 7 illustrates a cross section of the textured surface shown in FIGS. 1-3 along line 7-7 shown in FIG. 4.
Figure 8:
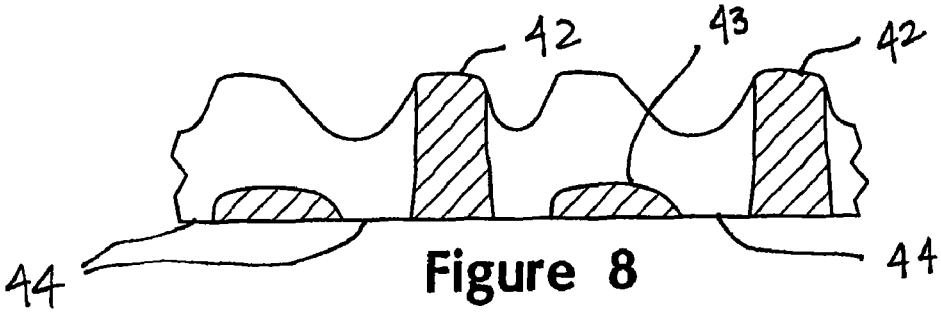
FIG. 8 illustrates a cross section of the textured surface shown in FIGS. 1-3 along line 8-8 shown in FIG. 4.
Figure 9:
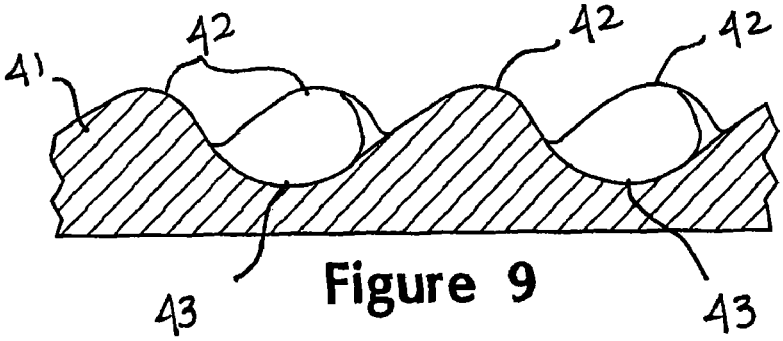
FIG. 9 illustrates a cross-section of the textured surface shown in FIGS. 1-3 along line 9-9 shown in FIG. 4.

FIG. 4-9 illustrate the textured surface 40 of the front portion 28 in greater detail. More particularly, FIG. 4 is a top plan view of the textured surface 40, while FIG. 5 is a perspective view of the textured surface 40. FIG. 6 then illustrates a cross section of the textured surface 40 along line 6-6 shown in FIG. 4. FIG. 7 illustrates a cross-section of the textured surface 40 along line 7-7 shown in FIG. 4. FIG. 8 illustrates a cross-section of the textured surface 40 along line 8-8 shown in FIG. 4, and FIG. 9 illustrates a cross-section of the textured surface 40 along line 9-9 shown in FIG. 4.

As seen in these figures, the textured surface 40 is made up of a series of contoured structures 41. That is, each structure 41 is contoured in that it has a curving or irregular outline. With the illustrated example, each contoured structure 41 is wave-shaped, as may be best seen in FIG. 9. Each structure includes a series of peaks 42, with each adjacent pair of peaks 42 along the structure 41 being separated by a trough 43. The contoured structures 41 are arranged in parallel to each other along their length. Further, as may best be seen in FIGS. 4 and 8, adjacent contoured structures 41 are out of phase with each other by approximately 180°. That is, the peak 42 of one contoured structure 41 is immediately adjacent to the troughs 43 of the two neighboring contoured structures 41. Likewise, each trough 43 of one contoured structure 41 is adjacent to the peaks 42 of the two neighboring contoured structures 41. Thus, these structures 41 form an alternating series of raised heights and depressions extending in two orthogonal directions. As will be apparent from the figures, this alternating series of contoured structures 41 provides the textured surface 40 with a rough, irregular feel. Accordingly, the textured surface 40 will provide greater traction than the surface of a conventional shoe upper when rubbed along another surface, such as the top, bottom, or edge of a skateboard deck.

In addition to the peaks 42 and troughs 43 of the contoured structures 41, the textured surface 40 optionally also may include one or more apertures. For example, in the embodiment of the invention illustrated in FIG. 4-9, the textured surface 40 defines a pattern of apertures 44. More particularly, an aperture 44 is formed between adjacent contoured structures 41, so as to separate each trough 43 from the peaks 42 of the adjacent contoured structures 41. Of course, still other implementations of invention may provide more or fewer apertures 44. Further, alternate examples of the invention may position the apertures at different locations, as desired. As will be appreciated by those of ordinary skill in the art, the apertures allow the textured surface 40 to "breathe." That is, the apertures 44 may allow moisture to escape from the inside of the shoe 10, and allow fresh air to enter into the inside of the shoe 10, thereby assisting in keeping the wearer's foot cool and dry.

The contoured structures 41 providing the textured surface 40 may be formed from a variety of polymer materials that include rubber, silicone, thermoplastic polyurethane, polypropylene, polyethylene, ethylvinylacetate, and styrene ethylbutylene styrene, for example. A variety of manufacturing processes may be utilized to form the contoured structures 41. As examples, the contoured structures 41 may be shaped through any desired molding or casting processes. In addition, various etching and milling processes may be utilized to form contoured structures 41. With various examples of the invention, the material forming the contoured structures 41 can be selected so that the front portion 28 provides a comfortable and compliant structure that extends adjacent to the foot, and which may stretch to accommodate foot movements and differences in foot dimensions.

Figure 10:
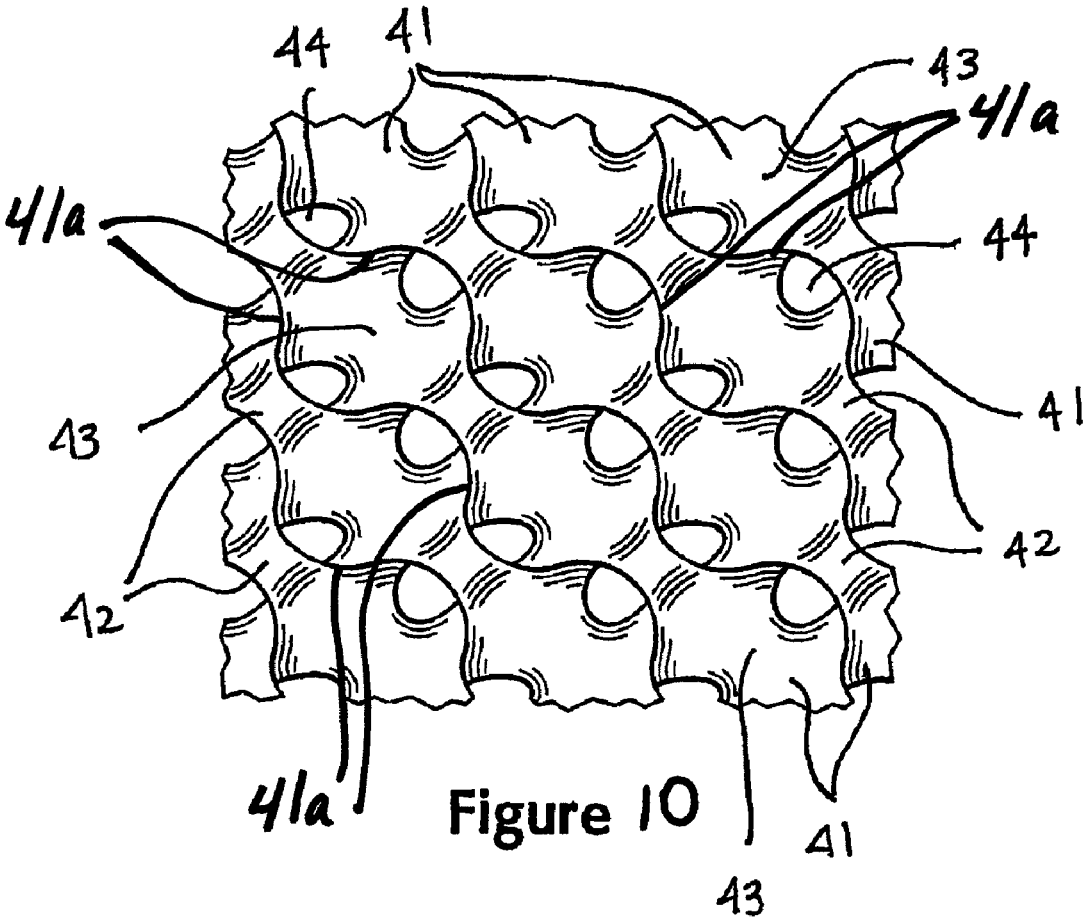
FIG. 10 is a top plan view of the textured surface according to other disclosed aspects.

It should be noted that, with the embodiment of the invention illustrated in FIGS. 4-9, the contoured structures 41 are formed from a single piece of material. That is the alternating contoured structures 41 are continuously formed with each other. Referring to FIG. 10, alternate examples of invention, however, may form the contoured structures 41 from separate pieces of material, and then subsequently join the separate contoured structures 41 along their outlines 41*a* using any desired technique, such as adhesives, interleaving, or any other appropriate method.

It also should be appreciated that other types of contoured structures 41 may be used to form the textured surface 40. For example, instead of the wave-shaped outline specifically illustrated in FIGS. 4-9, other embodiments of the invention may employ contoured structures 41 that have a different wave-shaped outline. Further, rather than the regular pattern of raised structures and depressions provided by alternating wave-shaped contoured structures 41 as illustrated in FIGS. 4-9, alternate examples of the invention may employ contoured structures 41 that each form an individual raised structure positioned in either a regular or an irregular pattern. It also should be appreciated that, with some embodiments of the invention, the heights of the raised structures (e.g., the peaks 42) or, alternately or additionally, the depths of the depressions (e.g., the troughs 43) between the raised structures may be varied in order to change the flexibility of the textured surface 40. Further, with some embodiments of the invention, the distance between adjacent raised structures (e.g., peaks 42) may be varied in order to change the flexibility of the textured surface 40.

Further, various areas of the textured surface 40 can be formed of different arrangements of contoured structures 41. For example, with some implementations of the invention, separate groups of the contoured structures 41 illustrated in FIGS. 4-9 may be provided at different angles over alternating areas of the front portion 28 (e.g., in a checkerboard pattern). Also, the wave shaped contoured structures 41 illustrated in FIGS. 4-9 may be alternated over the front portion 28 with other type of contoured structures 41 to provide the textured surface 40.

Still further, it should be noted that, while the specific example illustrated in FIGS. 1-3 provide the textured surface 40 over only the front portion 28 of the upper 20, with alternate examples of the invention the textured surface 40 may be extended over any desired portion of the upper 20, including over the entirety of the upper 20. With these examples, the upper 10 may not be divided into a front portion 28 and a rear portion 27. Still further, with some examples of the invention, the size of the front portion 28 may be reduced to covering, for example, only the forefoot region 10 of the upper 20, the vamp area 23, or some other smaller portion of the shoe 10. With yet other examples of invention, the textured surface 40 may be separate from the upper 20. For example, the contoured structures 41 may be formed in a layer of material so as to define the textured surface 40 on one side can and a smooth surface on the opposing side. Adhesive or another fastening structure can then be applied to the smooth side, so that the material can be fastened to the existing upper 20 of a conventional article of footwear.

While the invention has been described with respect to specific examples including presently preferred modes of carrying out the invention, those skilled in the art will appreciate that there are numerous variations and permutations of the above described systems and techniques that fall within the spirit and scope of the invention as set forth above.

What is claimed is:

1. An article of footwear, comprising:

a sole, and an upper, at least a portion of the upper having a textured surface including a first elongated arrangement of a series of alternating peaks and troughs and a second elongated arrangement of a series of alternating peaks and troughs, and wherein the first elongated arrangement lies parallel to the second elongated arrangement, wherein a peak of the first elongated arrangement lies immediately adjacent to a trough of the second elongated arrangement, wherein the highest points of the peaks do not form a substantially flat interconnected network and wherein the lowest points of the troughs do not form a substantially flat interconnected network.

2. The article of footwear recited in claim 1, wherein a majority of the upper has a textured surface.

3. The article of footwear recited in claim 1, wherein the first and second elongated arrangements are provided by first and second contoured structures, respectively, wherein each contoured structure has an outlined shaped, when viewed from above the textured surface.

4. The article of footwear recited in claim 3, wherein the textured surface is formed from separate contoured structures subsequently joined together to form the textured surface.

5. The article of footwear recited in claim 3, wherein each contoured structure defines an elongated length direction, and the textured surface includes:

a first group of contoured structures arranged in parallel with their length directions oriented at a first angle; and a second group of contoured structures arranged in parallel with their length directions oriented at a second angle different from the first angle.

6. The article of footwear recited in claim 3, wherein the first contoured structure differs from the second contoured structure.

7. The article of footwear recited in claim 3, wherein each contoured structure has a non-linear outline, when viewed from above the textured surface.

8. The article of footwear recited in claim 7, wherein the non-linear outline of each contoured structure includes a series of regular curves.

9. The article of footwear recited in claim 8, wherein the first and second contoured structures are arranged:

in parallel along a length of the non-linear outlines of the contoured structures, and such that each peak of the first contoured structure is adjacent to a trough of the second contoured structure.

10. The article of footwear recited in claim 1, wherein the textured surface includes alternating peaks and troughs extending in two orthogonal directions.

11. The article of footwear recited in claim 10, wherein heights of the alternating peaks vary.

12. The article of footwear recited in claim 10, wherein depths of the alternating troughs vary.

13. The article of footwear recited in claim 10, wherein distances between the alternating peaks vary.

14. The article of footwear recited in claim 1, wherein the textured surface is formed from a single piece of material.

15. The article of footwear recited in claim 1, further comprising a plurality of apertures defined by the textured surface.

16. The article of footwear recited in claim 1, wherein the textured surface is formed from one or more materials selected from the group consisting of: rubber, silicone, thermoplastic polyurethane, polypropylene, polyethylene, ethylvinylacetate, and styrene ethylbutylene styrene.

17. The article of footwear recited in claim 1, wherein the textured surface is shaped by a process selected from the group consisting of: a molding process, a casting process, an etching process, and a milling process.

18. A method of manufacturing an article of footwear, comprising:

forming a textured surface on a first side of a layer of material, the textured surface including a first elongated arrangement of a series of alternating peaks and troughs and a second elongated arrangement of a series of alternating peaks and troughs, wherein the first elongated arrangement lies parallel to the second elongated arrangement and wherein a peak of the first elongated arrangement lies immediately adjacent to a trough of the second elongated arrangement;

forming a smooth surface on a second side of the layer of material opposite the first side; and fastening the smooth surface of the layer of material to an exterior surface of an upper of an article of footwear.

19. The method recited in claim 18, wherein the smooth surface of the layer of material is fastened to the upper of the article of footwear using adhesive.

20. The article of footwear recited in claim 1, wherein the peaks of the first elongated arrangement have an asymmetric height profile.

21. The article of footwear recited in claim 1, wherein the peaks of the first elongated arrangement have a first width and wherein the troughs of the first elongated arrangement have a second width that differs from the first width.

22. The article of footwear recited in claim 1, wherein the textured surface includes peaks having differing shapes.

23. An article of footwear, comprising:

a sole, and an upper having an outer surface facing away from a user's foot, at least a portion of the outer surface of the upper having a textured outer surface including a first plurality of raised heights, wherein the raised heights are regularly spaced in a first direction, wherein the raised heights have a non-symmetric cross-section, wherein the textured outer surface includes a plurality of depressions separating the plurality of raised heights, and wherein the depressions are not interconnected, wherein heights of the first plurality of raised heights vary.

24. The article of footwear recited in claim 23, wherein the textured outer surface includes a plurality of apertures.

25. The article of footwear recited in claim 23, wherein the textured outer surface includes a second plurality of raised heights arranged in parallel along the first direction with the first plurality of raised heights, such that the raised heights of the first plurality are not aligned with the raised heights of the second plurality.

26. The article of footwear recited in claim 23, wherein at least a portion of a forefoot region of the upper includes the textured outer surface.

27. The article of footwear recited in claim 23, wherein a plurality of the raised heights have a slanted height profile such that a first side of the slanted height profile has a more gradual slope than a second side of the slanted height profile.

28. An article of footwear, comprising:

a sole, and an upper having an outer surface facing away from a user's foot, at least a portion of the outer surface of the upper having a textured outer surface including a first plurality of raised heights, wherein the raised heights are regularly spaced in a first direction, wherein the raised heights have a non-symmetric cross-section, wherein the textured outer surface includes a plurality of depressions separating the plurality of raised heights, and wherein the depressions are not interconnected, wherein a plurality of the raised heights have a slanted height profile such that a first side of the slanted height profile has a more gradual slope than a second side of the slanted height profile, and wherein the textured outer surface includes a contoured structure formed from the first plurality of raised heights alternating with the plurality of depressions, the contoured structure having a width dimension that varies non-linearly along a length direction of the contoured structure.

29. An article of footwear, comprising:

a sole, and an upper having an outer surface facing away from a user's foot, at least a portion of the outer surface of the upper having a textured outer surface including a first plurality of raised heights, wherein the raised heights are regularly spaced in a first direction, wherein the raised heights have a non-symmetric cross-section, wherein the textured outer surface includes a plurality of depressions separating the plurality of raised heights, and wherein the depressions are not interconnected, wherein a plurality of the raised heights have a slanted height profile such that a first side of the slanted height profile has a more gradual slope than a second side of the slanted height profile, and wherein the textured outer surface includes a contoured structure formed from the first plurality of raised heights alternating with the plurality of depressions, the contoured structure having a curved outline along a length direction of the contoured structure when viewed from above the textured surface.

30. The article of footwear recited in claim 28, wherein heights of the first plurality of raised heights vary.

* * * * *